US006718728B2

(12) United States Patent
Antoniazzi et al.

(10) Patent No.: US 6,718,728 B2
(45) Date of Patent: Apr. 13, 2004

(54) PACKING MACHINE

(75) Inventors: Luca Antoniazzi, Bologna (IT); Andrea Cinotti, Bologna (IT)

(73) Assignee: Casmatic S.p.A., Casalecchio di Reno (IT)

( * ) Notice: Subject to any disclaimer, the term of this patent is extended or adjusted under 35 U.S.C. 154(b) by 83 days.

(21) Appl. No.: 10/061,528

(22) Filed: Feb. 1, 2002

(65) Prior Publication Data

US 2002/0116895 A1 Aug. 29, 2002

(30) Foreign Application Priority Data

Feb. 2, 2001 (IT) ..... TO2001A0100

(51) Int. Cl.[7] ..... B65B 11/06; B65B 49/00
(52) U.S. Cl. ..... 53/230; 53/375.9
(58) Field of Search ..... 53/463, 466, 228–233, 53/375.9; 493/475, 476, 478, 479

(56) References Cited

U.S. PATENT DOCUMENTS

| | | | | | |
|---|---|---|---|---|---|
| 1,586,375 | A | * | 5/1926 | Metcalf | 53/375.9 |
| 4,313,290 | A | * | 2/1982 | Furuya et al. | 53/230 |
| 6,067,780 | A | * | 5/2000 | Gentili et al. | 53/230 |

FOREIGN PATENT DOCUMENTS

| | | | | | |
|---|---|---|---|---|---|
| DE | 1912445 | A | * | 3/1965 | |
| FR | 1456961 | A | * | 10/1966 | B65B/59/00 |
| GB | 0678092 | A | * | 8/1952 | |
| JP | 02219711 | A | * | 9/1990 | B65B/11/12 |

* cited by examiner

*Primary Examiner*—Stephen F. Gerrity
(74) *Attorney, Agent, or Firm*—Michael Best & Friedrich LLP

(57) ABSTRACT

A machine for packing groups of rolls of domestic paper in respective sheets of packing material has folding members, each of which has an active portion, which is brought into contact with a flap of a sheet of packing material, and an adjusting device for adjusting the extension of the active portion in a first direction.

17 Claims, 5 Drawing Sheets

Fig.2
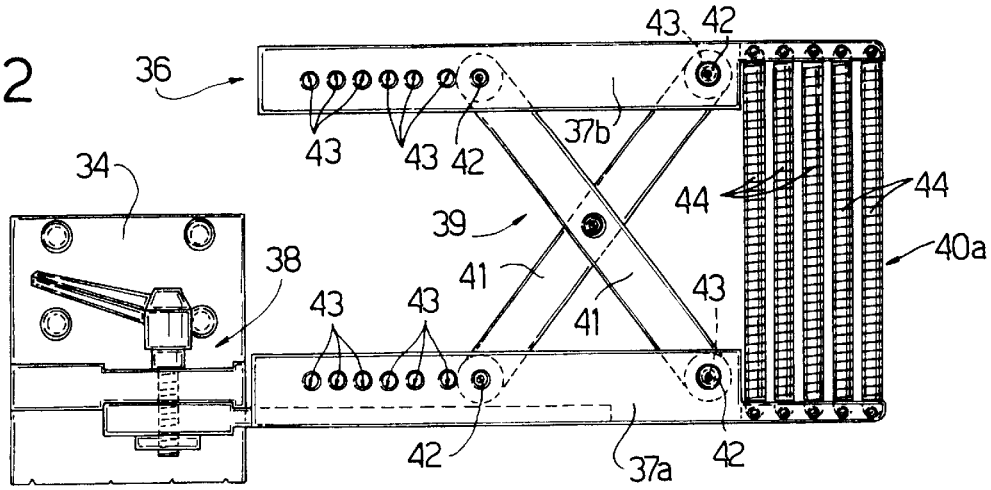
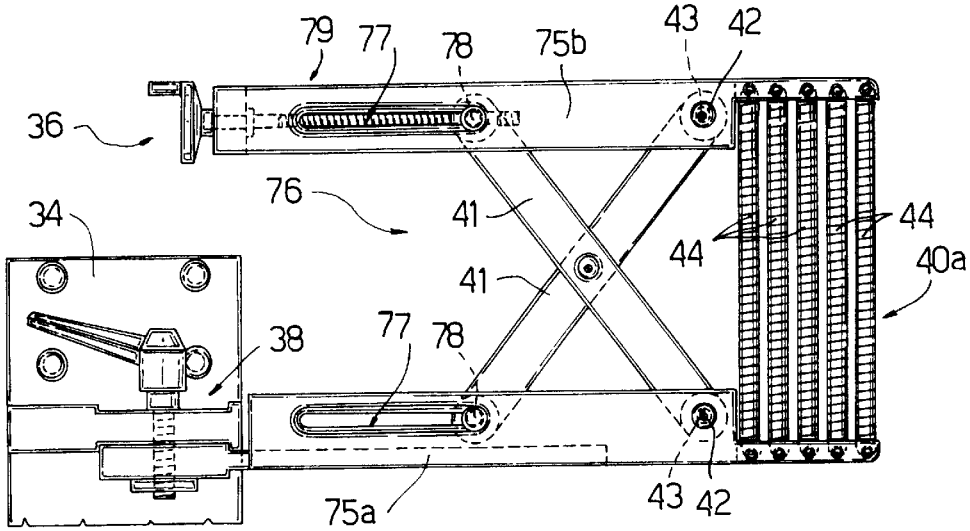
Fig.3
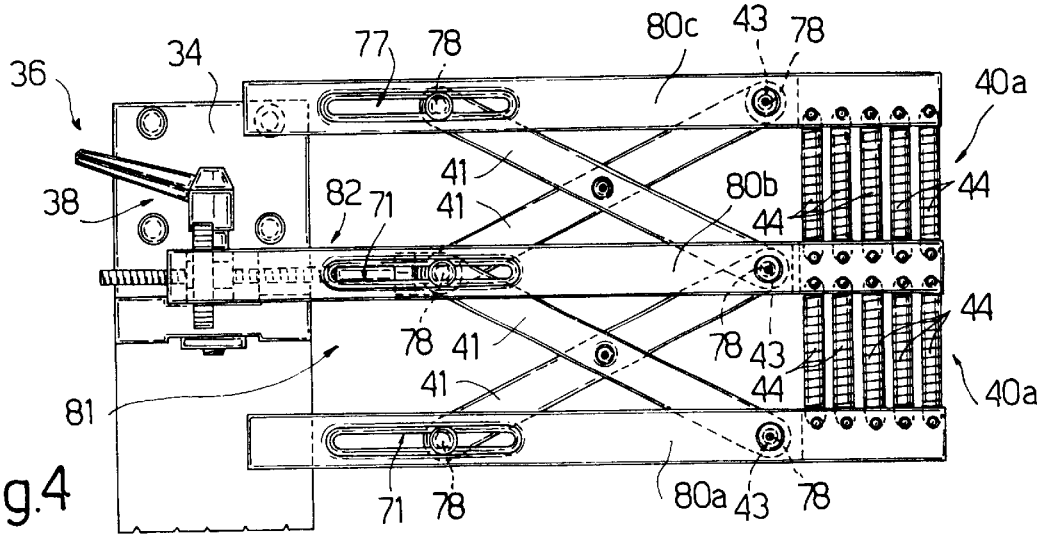
Fig.4

PACKING MACHINE

The present invention relates to a packing machine.

More specifically, the present invention relates to a machine for packing orderly groups of rolls of domestic paper, to which the following description refers purely by way of example.

BACKGROUND OF THE INVENTION

Known machines for packing groups of rolls of domestic paper normally comprise folding members located along the path of the groups to fold flaps of a sheet of packing material, and each of which comprises an active portion which is brought into contact with a corresponding flap to fold it on to the group. To obtain a fold with no creases, the active portion must be brought into contact with the whole surface of the flap being folded, but without interfering with the rest of the sheet of packing material. The size of the flaps depends on the size of the group, which in turn depends on the size and number of individual articles in the group, whereas currently used packing machines have the drawback of being designed to pack groups of constant size and as such are not very versatile.

SUMMARY OF THE INVENTION

It is an object of the present invention to provide a highly versatile packing machine designed to pack groups of articles of various sizes.

According to the present invention, there is provided a machine for packing groups of articles in respective sheets of packing material, the machine comprising at least one folding member having at least one active portion which is brought into contact with a flap of a sheet of packing material; and being characterized in that said folding member comprises an adjusting device for adjusting the extension of said active portion at least in a first direction.

BRIEF DESCRIPTION OF THE DRAWINGS

A non-limiting embodiment of the present invention will be described by way of example with reference to the accompanying drawings, in which:

FIG. 2 shows a larger-scale side view, with parts removed for clarity, of a folding member of the FIG. 1 machine;

FIG. 3 shows a larger-scale side view, with parts removed for clarity, of a first variation of the FIG. 2 folding member;

FIG. 4 shows a larger-scale side view, with parts removed for clarity, of a second variation of the FIG. 2 folding member;

DETAILED DESCRIPTION OF THE INVENTION

Figure 1:
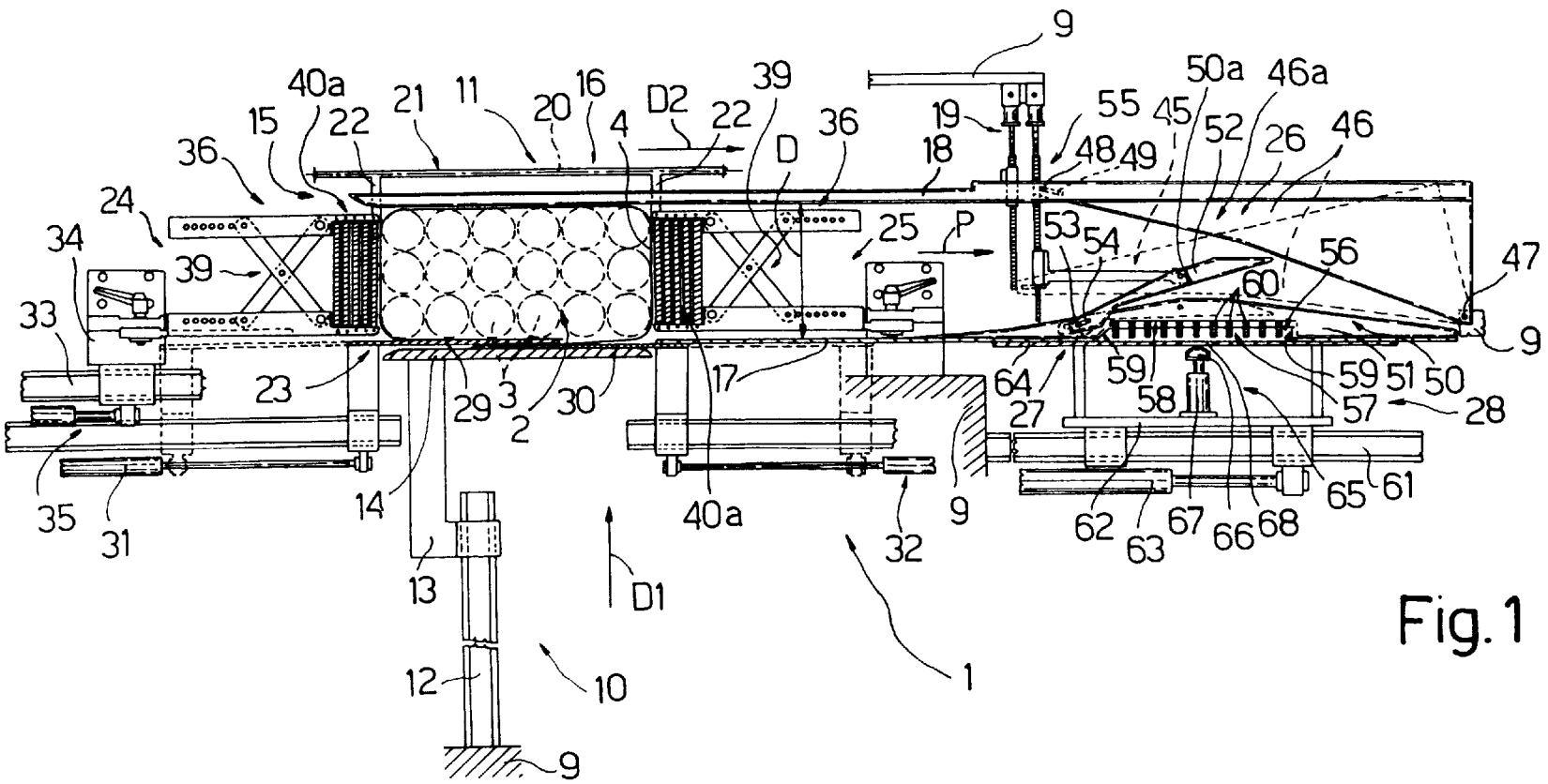
FIG. 1 shows a side view, with parts in section ad parts removed for clarity, of a machine for packing groups of articles in accordance with the present invention.
Figure 11:
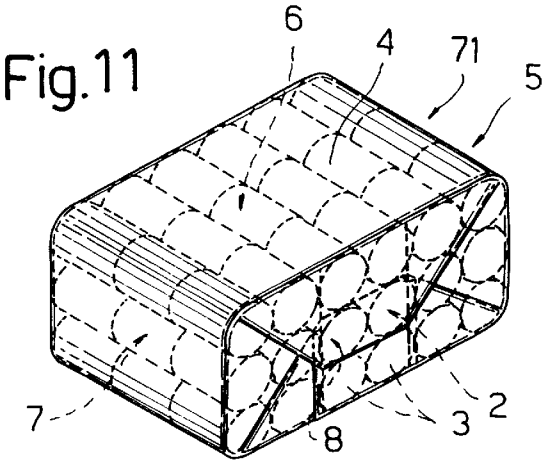

Number 1 in FIG. 1 indicates as a whole a machine for packing groups 2 of rolls 3 of domestic paper in relative sheets 4 of packing material to form packs 5, one of which is shown in FIG. 11.

Figure 7:
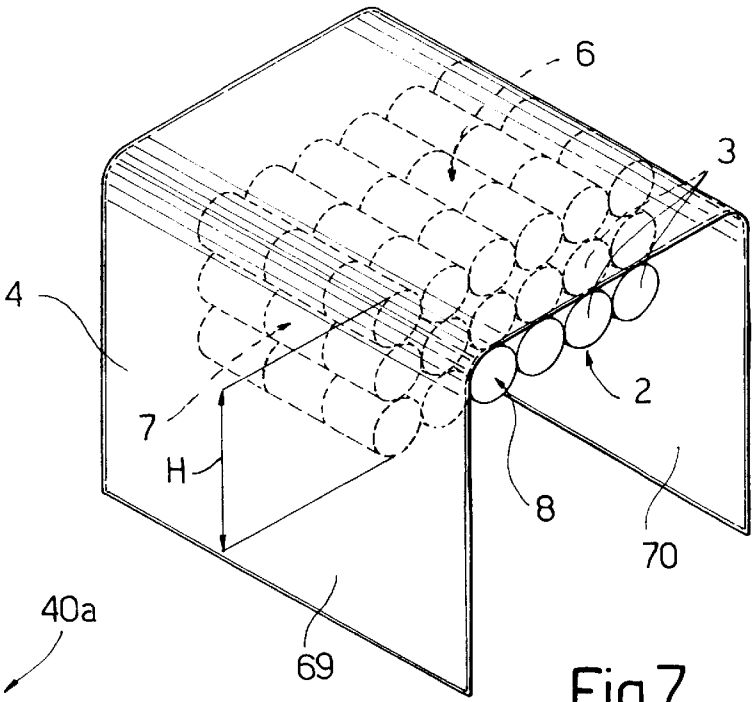
FIGS. 7 to 11 show views in perspective of various steps in the packing of groups of articles on the FIG. 1 machine.

With reference to FIG. 7, each group 2 is substantially in the form of a parallelepiped of height H and having two main faces 6, two lateral faces 7, and two end faces 8. Faces 6 and 7 have undulated surfaces formed by the cylindrical surfaces of adjacent rolls 3, whereas end faces 8 have substantially flat surfaces.

In a variation not shown, group 2 comprises rolls 3 positioned vertically as opposed to horizontally as shown in FIGS. 1, 7–11.

With reference to FIG. 1, machine 1 comprises a frame 9 supporting a conveyor 10 for conveying groups 2 in a vertical direction D1, and a conveyor 11 for conveying groups 2, partly wrapped in respective sheets 4 of packing material, in a horizontal direction D2.

Conveyor 10 comprises a guide 12 integral with frame 9; a carriage 13 running along guide 12 in vertical direction D1; and a platform 14 integral with carriage 13 and for lifting and feeding a group 2 in direction D1 to conveyor 11. Carriage 13 and platform 14 are operated by a known actuator not shown.

Conveyor 11 comprises a tunnel 15 extending in direction D2 and defining a path P; and a chain conveyor 16 for feeding group 2 and sheet 4 of packing material along tunnel 15 and path P. Tunnel 15 comprises a bottom wall 17 fixed to frame 9, extending in direction D2, and defining a slideway for groups 2; and a top wall 18 located over wall 17, movable in direction D1, and connected to frame 9 by an adjusting device 19 for adjusting the distance D between top wall 18 and bottom wall 17.

Chain conveyor 16 is fitted to frame 9 in a manner not shown, and comprises a chain 20 in turn comprising a work branch 21 over wall 18 and parallel to direction D2, and pairs of partitions 22, which define a seat sized to house a group 2 of articles 3, and penetrate inside tunnel 15 through openings (not shown) formed in wall 18.

Machine 1 also comprises folding devices 23, 24, 25, 26, 27 for folding sheet 4 about group 2 along tunnel 15; and a sealing device 28 for sealing sheet 4 about group 1. In actual fact, folding devices 23, 24, 25, 26, 27 and sealing device 28 form part of tunnel 15.

Folding device 23 comprises two blades 29 and 30 parallel to and substantially coplanar with bottom wall 17; and two actuators 31 and 32 for moving respective blades 29 and 30 between a rest position shown by the dash line, and a work position shown by the continuous line in FIG. 1.

Folding device 24 comprises a guide 33 integral with frame 9 and parallel to direction D2; a carriage 34 running along guide 33; a drive 35 for driving carriage 34; and two facing, specularly symmetrical folding members 36 fixed to carriage 34.

With reference to FIG. 2, each folding member 36 comprises two parallel bars 37*a* and 37*b*; a screw fastener 38 for connecting bar 37*a* to carriage 34; an adjusting device 39 for adjusting the distance between bars 37*a* and 37*b* in direction D1; and a portion 40*a* extensible in direction D1 and connected to bars 37*a* and 37*b*. Portion 40*a* is referred to as active by being the portion of folding member 36 which comes into direct contact with sheet 4 of packing material during the folding operations. Adjusting device 39 comprises two levers 41 connected to each other in articulated manner to form an X, and fixed at the ends to bars 37*a* and 37*b* by means of pins 42 engaging holes 43 formed along bars 37*a* and 37*b*.

Bars 37*a* and 37*b* have a number of adjacent holes 43 engageable selectively by pins 42 to alter the configuration of the two levers 41 and to adjust the distance between bars 37*a* and 37*b* and the extension of active portion 40*a* in direction D1.

Active portion 40*a* comprises a series of parallel, side by side coil springs 44, each of which is fixed at the ends to bars 37*a* and 37*b* and is coiled in the same direction as the adjacent springs 44. The coil direction of springs 44 is selected to exploit the thrust of the coil on sheet 4 as sheet 4 moves with respect to portion 40*a*, and, more specifically, is selected to produce an upward thrust as sheet 4 moves with respect to portion 40*a* in direction D2. Springs 44 are connected to bars 37*a* and 37*b* at points aligned along two respective straight lines, or along two curved paths to form a diverging portion 40*a*.

With reference to FIG. 1, folding device 25 is fixed with respect to tunnel 15, and comprises two facing, parallel folding members 36 fixed to frame 9 by respective fasteners 38.

Figure 6:
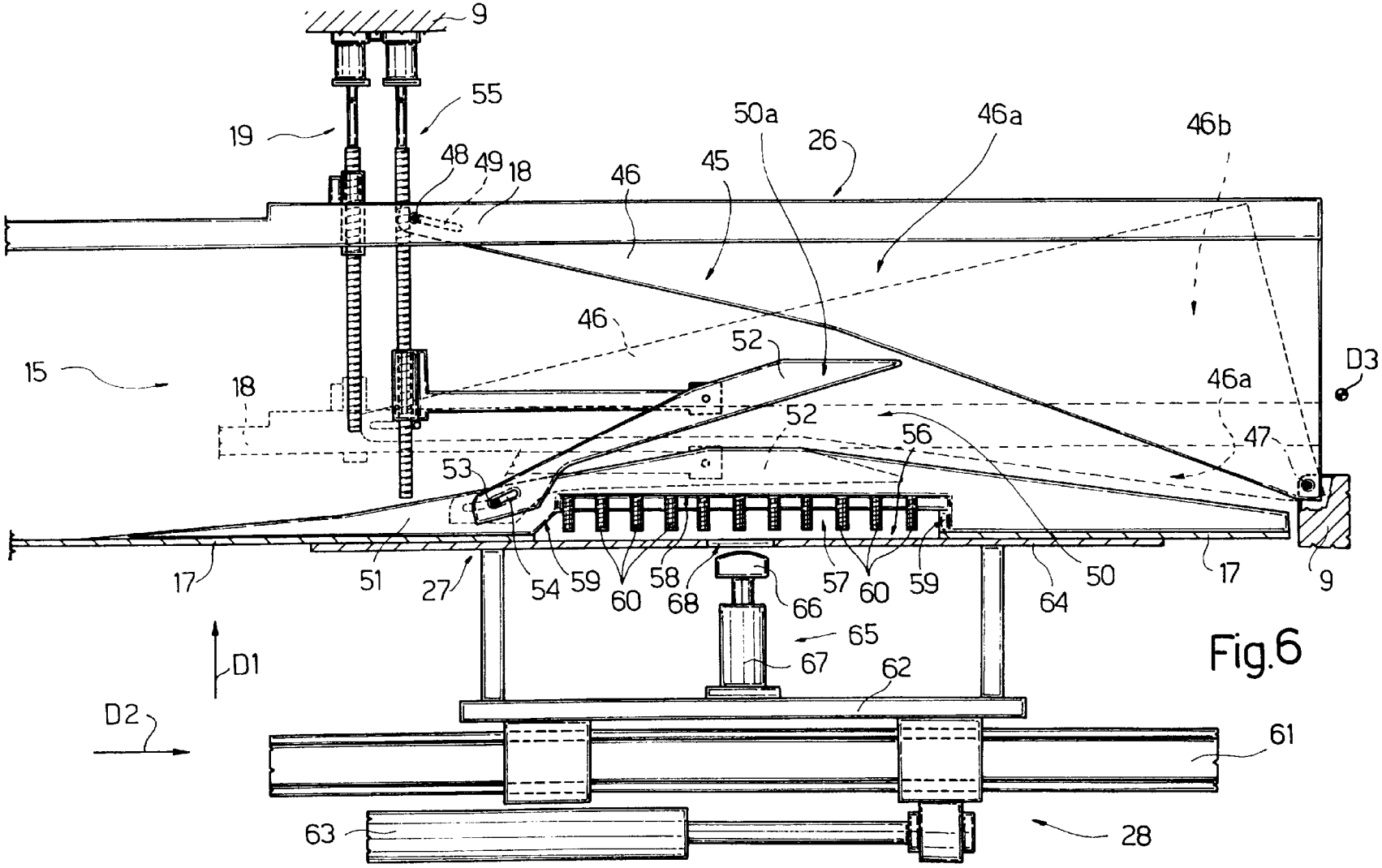
FIG. 6 shows a larger-scale side view, with parts in section and parts removed for clarity, of a second detail of the FIG. 1 machine.
Figure 8:
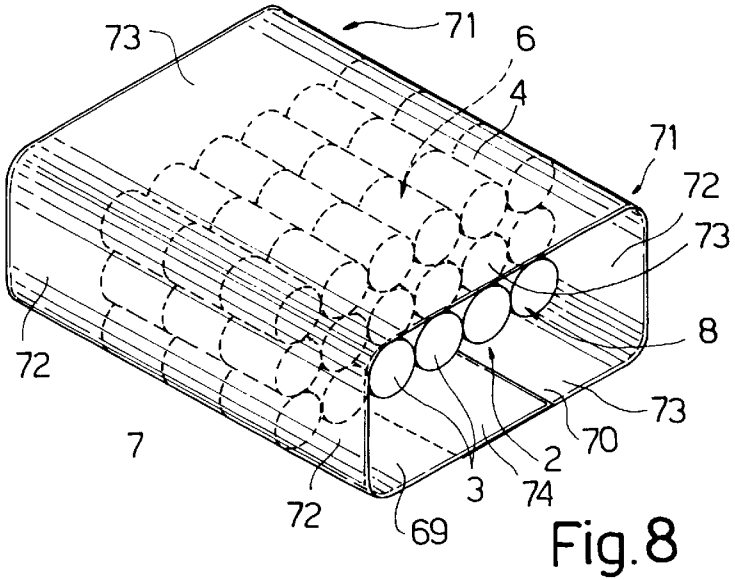

With reference to FIG. 6, folding device 26 comprises two facing folding members 45 (only one shown in FIG. 6), each of which comprises a triangular screw 46 having a first end pivoting on frame 9, at bottom wall 17, about an axis 47 parallel to a direction D3 perpendicular to directions D1 and D2, and a second end pivoting on top wall 18, which has a pin 48 parallel to axis 47 and engaging a slot 49 in screw 46. When top wall 18 is lowered by adjusting device 19 towards bottom wall 17 in direction D1 (position shown by the dash line in FIG. 6), folding member 45 is oriented about axis 47 so that screw 46 has a portion 46*a* beneath wall 18, and a portion 46*b* above wall 18. That is, adjustment of top wall 18 rotates screw 46 about axis 47 and adjusts the extension of screw 46. In other words, screw 46 has an active portion 46*a* which varies alongside a variation in the position of top wall 18, and assumes the full extension of screw 46 when wall 18 is in the top limit position. Regardless of the extension adjustment of screw 46, rotation of screw 46 about axis 47 adjusts the extension of active portion 46*a* in direction D1.

Folding device 27 comprises two facing, specularly symmetrical folding members 50, only one of which is shown in FIG. 6. Each folding member 50 comprises a screw 51 integral with wall 17; an appendix 52 hinged to screw 51 about a pin 53, which is parallel to axis 47, is integral with screw 50, and engages a slot 54 in appendix 52; and an adjusting device 55 having a screw-nut screw mechanism for adjusting the orientation of appendix 52 about pin 53.

Wall 17 has an opening 56, through which sealing device 28 is brought into contact with sheet 4 of packing material, and at which each screw 51 has a recess 57 extending the full length of opening 56 in direction D1.In other words, each screw 51 is in the form of an upside down U to bridge opening 56. Recess 57 is defined by a top edge 58 and two lateral edges 59, and is partly occupied by coil springs 60 fixed to the top edge 58 of screw 51 and coiled in the same direction so as to lift sheet 4 of packing material as group 2 moves with respect to screw 51.

In other words, folding member 50 has an active portion 50 defined by screw 51, appendix 52, and springs 60, and the extension of which in direction D1 is adjusted by rotating appendix 52 about pin 53.

Device 28 comprises a guide 61 parallel to direction D1; a carriage 62 running along guide 61; and an actuator 63. Carriage 62 supports a wall 64 contacting wall 17 to close opening 56; and a sealing member 65 having a sealing head 66 and an actuator 67 for moving head 66 back and forth in direction D1. Wall 64 has an opening 68 for the passage of sealing head 66 and smaller than opening 56; and the movement of carriage 62 in direction D1 provides for setting sealing head 66 and opening 68 to the best position for sealing various types of groups 2.

In actual use, machine 1 is set to pack groups 2 according to the size of groups 2. That is, the height H of group 2 determines the distance D between walls 17 and 18, and the extension of active portions 40*a*, 46*a* and 50*a* of respective folding members 36, 45 and 50; and the size of group 2 parallel to direction D2 determines the setting of sealing head 66 in direction D2 by means of carriage 62.

Once machine 1 is set to pack a given type of group 2, the packing cycle is started, and which provides for lifting a group 2 on platform 14 in direction D1 so as to intercept a sheet 4 held in a horizontal position by known devices (not shown), and bring the sheet 4 into contact with wall 18 and between partitions 22. As group 2 and sheet 4 are raised, sheet 4 contacts the free edge of blades 29 and 30 positioned as shown by the dash lines in FIG. 1, and is folded into a U about group 2 as shown in FIG. 7, in which the U-folded sheet 4 of packing material has two flaps 69 and 70 projecting downwards. With reference to FIG. 1, blades 29 and 30 are then moved into the closed position (shown by the continuous lines in FIG. 1) between platform 14 and group 2, so as to fold flaps 69 and 70 on to the bottom main face 6 of group 2 and form the tubular wrapping shown in FIG. 8. The tubular wrapping has two tubular portions 71 projecting from opposite end faces 8 of group 2; each tubular portion 71 has two lateral flaps 72 parallel to direction D1, and two main flaps 73 parallel to direction D2; and the tubular wrapping as a whole has a portion 74 defined by superimposing end portions of flaps 69 and 70.

Figure 9:
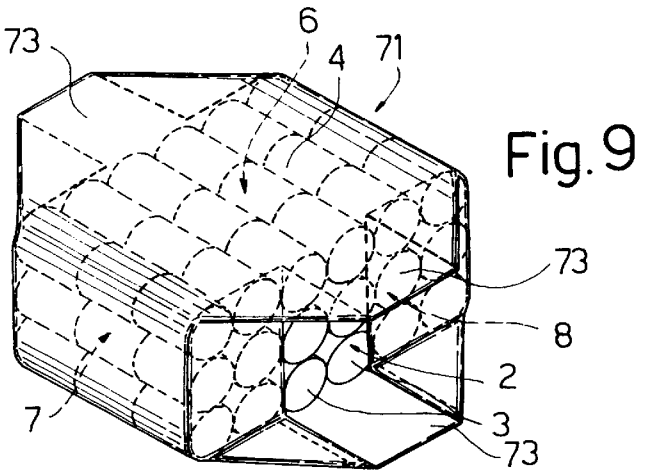
Figure 10:
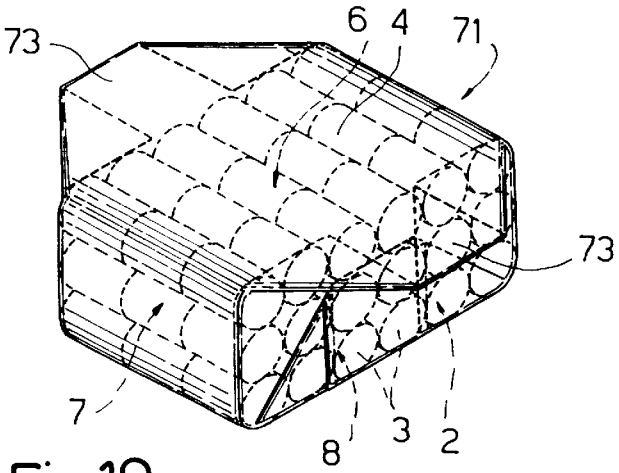

Once the tubular wrapping is formed, folding device 24 moves folding members 36 into a work position in which to fold the lateral flaps 72 located upstream in the traveling direction of group 2 (from left to right in FIG. 1). Chain conveyor 16 then feeds group 2 in direction D2 to bring the downstream lateral flaps 72 into contact with folding members 36 of fixed folding device 25 and fold the downstream lateral flaps 73 on to group 2 as shown in FIG. 9. As group 2 and relative sheet 4, partly folded about group 2, are fed forward further, the bottom main flaps 73 are folded squarely by folding device 27 as shown in FIG. 10. At a stop in the operation of conveyor 16, sealing head 66 is inserted through opening 68 into contact with portion 74, is heated to melt sheet 4 of packing material along portion 74, and is pushed against group 2, which is deformed so that sealing head 66 penetrates inside tunnel 15 and deforms coil springs 60 contacting sealing head 66.

Once the seal is made, sealing head 66 is withdrawn, and group 2 is fed from right to left in direction D2 so that folding device 26 folds the top main flaps 73 squarely to form the pack 5 shown in FIG. 11.

With reference to the FIG. 3 variation, folding member 36 comprises two bars 75*a* and 75*b*, between which the active portion 40*a* defined by springs 44 extends; and an adjusting device 76. Each bar 75*a*, 75*b* differs from bars 37*a*, 37*b* by having one hole 43 and a slot 77 in place of the number of holes 43. Adjusting device 76 comprises two levers 41, each pivoting at one end on a pin 42 at hole 43, and at the other end on a pin 78 engaging slot 77; and a screw-nut screw mechanism 79 located along bar 75*b* to determine the position of pin 78 along slot 77 and, consequently, the extension of active portion 40*a* in direction D1. Bar 75*a* is connected to carriage 34 by screw fastener 38.

The above variation of folding member 36 provides for accurate, as well as faster, adjustment of the extension of portion 40*a* in direction D1 by virtue of screw-nut screw mechanism 79.

With reference to the FIG. 4 variation, folding member 36 comprises three parallel bars 80*a*, 80*b*, 80*c*; an adjusting device 81 cooperating with and for adjusting the distance between bars 80*a*, 80*b*, 80*c*; and two active portions 40*a*, each extending between two adjacent bars 80*a*, 80*b*, 80*c*.

Bar 80*b* is located between bars 80*a* and 80*c*, and is fixed to carriage 34 by screw fastener 38; each bar 80*a*, 80*b*, 80*c* has a hole 43 and a slot 77; adjusting device 81 comprises two levers 41 pivoting in the form of an X between bars 80*a* and 80*b*, and two levers 41 pivoting in the form of an X between bars 80*b* and 80*c*; each lever 41 engages a hole 43 and a slot 77 as shown and described in the FIG. 3 variation; and adjusting device 81 comprises a screw-nut screw mechanism 82 located on bar 80*b* and for adjusting the extension of both active portions 40*a* in direction D1.

Folding member 36 in the FIG. 4 variation has the advantage of adjusting extension upwards and downwards by the same amount.

Figure 5:
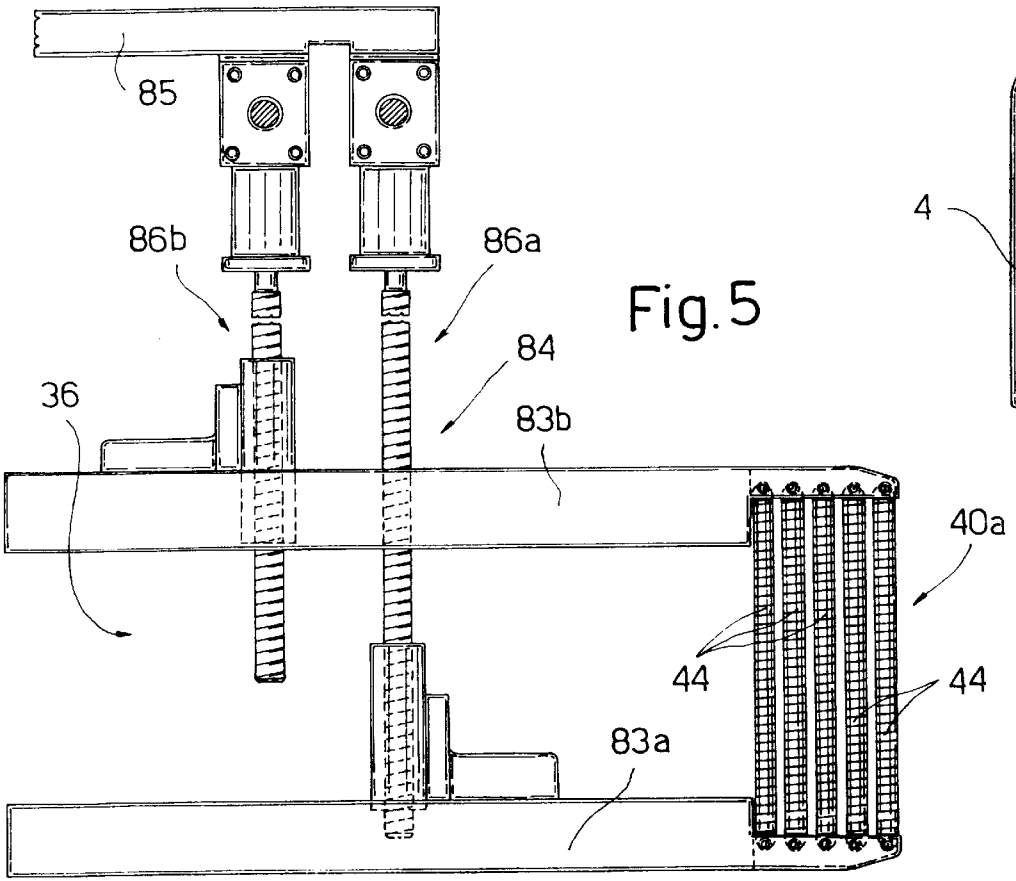
FIG. 5 shows a larger-scale side view, with parts removed for clarity, of a third variation of the FIG. 2 folding member.

With reference to the FIG. 5 variation, folding member 36 comprises two bars 83*a* and 83*b*, between which the active portion 40*a* defined by springs 44 extends; and an adjusting device 84 which also provides for supporting bars 83*a*, 83*b*. Adjusting device 84 comprises a support 85; and two electrically operated screw-nut screw mechanisms 86*a*, 86*b* fixed to support 85 and connected to respective bars 83*a*, 83*b* to adjust the extension of active portion 40*a*.

Folding member 36 in the FIG. 5 variation has the advantage of providing for accurate remote adjustment of both the extension and position of portion 40*a*. Support 85 may be fitted to carriage 34 to form folding device 24, and to frame 9 to form fixed folding device 25.

What is claimed is:

1. A machine for packing groups of articles in respective sheets of packing material, the machine comprising at least one folding member having at least one active portion which is brought into contact with a flap of a sheet of packing material; said folding member comprising an adjusting device for adjusting the extension of said active portion at least in a first direction, wherein said active portion is extensible in said first direction and comprises springs.

2. A machine as claimed in claim 1 wherein said springs are coil springs arranged side by side and parallel to the first direction.

3. A machine as claimed in claim 2 wherein said springs have respective coils coiled in the same direction.

4. A machine as claimed in claim 1 wherein said active portion extends, in said first direction, between two rigid supports.

5. A machine as claimed in claim 4 wherein said adjusting device adjusts the relative position of said rigid supports.

6. A machine as claimed in claim 5 wherein said adjusting device keeps one rigid support fixed.

7. A machine as claimed in claim 6 wherein said folding member comprises three rigid supports and two adjacent active portions.

8. A machine as claimed in claim 5 wherein said adjusting device comprises two adjusting mechanisms connected respectively to two rigid supports to adjust the position of each rigid support independently of the other.

9. A machine as claimed in claim 8 wherein said adjusting mechanisms are operated by respective remote controlled actuators.

10. A machine as claimed in claim 1, and comprising a fixed frame and a carriage movable with respect to said fixed frame in a second direction and supporting two specularly symmetrical folding members.

11. A machine as claimed in claim 1, and comprising a fixed frame supporting two specularly symmetrical folding members.

12. A machine as claimed in claim 1, and comprising a tunnel, along which a group of articles and a relative sheet of packing material are fed along a path (P); the tunnel comprising a number of said folding members and varying in size as a function of the size of said group in said first direction.

13. A machine as claimed in claim 12, wherein said tunnel comprises a bottom wall; a top wall; and an adjusting device for adjusting the distance between the bottom wall and the top wall.

14. A machine for packing groups of articles in respective sheets of packing material, the machine comprising at least one folding member having at least one active portion which is brought into contact with a flap of a sheet of packing material; and wherein the said folding member comprises a screw and an adjusting device for adjusting the extension of said active portion at least in a first direction pivoting at least partly about an axis perpendicular to the first direction, so that the orientation of the folding member about said axis varies the extension of said active portion in the first direction.

15. A machine for packing groups of articles in respective sheets of packing material, the machine comprising a frame and at least one folding member having at least one active portion which is brought into contact with a flap of a sheet of packing material; said folding member comprising an adjusting device for adjusting the extension of said active portion at least in a first direction, the folding member pivoting at least partly about an axis perpendicular to the first direction so that the orientation of the folding member about said axis varies the extension of said active portion in the first direction; said folding member further comprising a screw integral with the frame, and an appendix pivoting on said screw.

16. A machine as claimed in claim 14, characterized in that said screw comprises a recess partly occupied by deformable elements.

17. A machine as claimed in claim 16, characterized by a sealing device located at said screw; said recess preventing interference between said sealing device and said screw.

* * * * *